US005566761A

United States Patent [19]

Pallini, Jr. et al.

[11] Patent Number: 5,566,761

[45] Date of Patent: Oct. 22, 1996

[54] INTERNAL DRILLING RISER TIEBACK

[75] Inventors: Joseph W. Pallini, Jr., Tomball; Rockford D. Lyle, Pinehurst, both of Tex.

[73] Assignee: ABB Vetco Gray, Inc., Houston, Tex.

[21] Appl. No.: 497,306

[22] Filed: Jun. 30, 1995

[51] Int. Cl.[6] ..... E21B 33/038

[52] U.S. Cl. ..... 166/345; 285/18; 285/23

[58] Field of Search ..... 166/344, 345, 166/348; 285/18, 23, 24, 39

[56] References Cited

U.S. PATENT DOCUMENTS

| | | | |
|---|---|---|---|
| 4,046,405 | 9/1977 | Bonds | 285/39 X |
| 4,408,784 | 10/1983 | Reimert | 285/24 |
| 4,456,070 | 6/1984 | Watkins | 166/345 |
| 4,519,633 | 5/1985 | Nichols | 285/18 X |
| 4,681,166 | 7/1987 | Cuiper | 285/18 |
| 4,819,967 | 4/1989 | Calder et al. | 285/18 |
| 4,893,842 | 1/1990 | Brammer | 285/24 |
| 4,919,454 | 4/1990 | Caulfield et al. | 285/18 |
| 4,976,458 | 12/1990 | Hosie et al. | 285/24 |
| 5,222,560 | 6/1993 | Brammer et al. | 166/344 |
| 5,255,743 | 10/1993 | Adam et al. | 166/345 |
| 5,279,369 | 1/1994 | Brammer | 166/368 |
| 5,299,642 | 4/1994 | Nelson et al. | 166/368 |
| 5,368,335 | 11/1994 | Dinnes | 166/348 X |

*Primary Examiner*—Hoang C. Dang
*Attorney, Agent, or Firm*—James E. Bradley

[57] ABSTRACT

A tieback adapter will connect a tieback string between a subsea wellhead assembly and a platform at the surface. The tieback adapter has a housing in which a sub is carried. The sub has a lower end which contains a seal for sealingly engaging an internal sealing surface of a casing hanger located within the subsea wellhead assembly. The sub is connected on its upper end to the tieback string. The housing has a locking element which locks to an internal locking profile of the subsea wellhead assembly. A retainer carries the sub in an upward position within the housing while the tieback adapter is being lowered into the subsea wellhead assembly. A release device will release the retainer from the sub in response to the landing of the housing in the subsea wellhead assembly. This allows the sub to move downward. A cam surface on the sub simultaneously moves the locking element into engagement with the locking profile and the subsea wellhead assembly housing.

21 Claims, 5 Drawing Sheets

INTERNAL DRILLING RISER TIEBACK

BACKGROUND OF THE INVENTION

1. Field of the Invention

This invention relates in general to offshore drilling equipment and in particular to a tieback system for connecting a subsea well to a platform.

2. Description of the Prior Art

In a typical tieback system, a string of pipe will connect a subsea wellhead housing to a platform. A variety of tieback tools are employed to make the connection between the subsea wellhead and the lower end of the tieback string. In one type, the tieback string is lowered into engagement with the exterior of the wellhead housing. Then a running tool is lowered on drill pipe through the tieback string for making up a sealing connection with an internal casing hanger, typically by rotation of the drill pipe.

Occasions arise in which a tieback is desired to be made internally within a wellhead without using another running tool lowered through the tieback string. For example, when drilling in water several thousand feet deep, an external riser string with a blowout preventer at the surface will connect the subsea wellhead to the platform, which may be a tension leg platform. It may be desired to drill further through the subsea wellhead using an internal drilling riser within the external riser. The internal drilling riser will also have a blowout preventer at the surface. It would be important to be able to make up the tieback string in sealing engagement with the casing hanger within the subsea wellhead without the need for lowering a running tool through the internal drilling riser string.

SUMMARY OF THE INVENTION

This invention, the tieback tool has a housing with a sub carried in the housing. The sub has a lower end with a seal which will sealingly engage the internal sealing surface of the casing hanger within the subsea wellhead. The housing has a locking element that is carried by the housing for locking the housing to an internal locking profile of the wellhead assembly. The wellhead assembly inclues the wellhead housing and the wellhead connector on the lower end of the riser. The sub is initially carried in an upper position by a retainer while the tieback string is lowered into the subsea wellhead.

A release mechanism will disengage the retainer which holds the sub in the upper position upon response to the landing of the tieback tool in the subsea wellhead. Once released, the sub will move downward. A cam surface on the sub simultaneously moves the locking element into engagement with the internal locking profile of the wellhead assembly.

The tieback tool also has means to preload the connection with the subsea wellhead. This includes an upper portion of the sub which is rotatable relative to a lower portion of the sub. The upper sub portion has threads which will engage threads that are located within the housing on a preload sleeve carried within the housing. After the cam has moved the locking element into engagement with the profile in the wellhead assembly, the operator rotates the tieback string, causing the upper sub portion to rotate relative to the lower sub portion. The relative rotation of the threads drives both sub portions further downward relative to the housing, preloading the connection.

The preload sleeve latches to the housing by a latch ring. This latching engagement occurs when the upper and lower sub portions move downward in the housing. Once the preload sleeve has latched, it cannot move upward relative to the housing, allowing the preloading to occur.

The system has a retrieval mechanism that allows retrieval by rotating the tieback string in a reverse direction. The threads between the preload sleeve and the upper sub portion cause the upper and lower sub portions to move upward relative to the housing. This allows the locking elements to retract from engagement with the wellhead assembly. A retrieval sleeve moves upward with the upper sub portion to cause the latch ring to retract to place the tieback tool back in the initial position.

DETAILED DESCRIPTION OF THE INVENTION

Figure 1A:
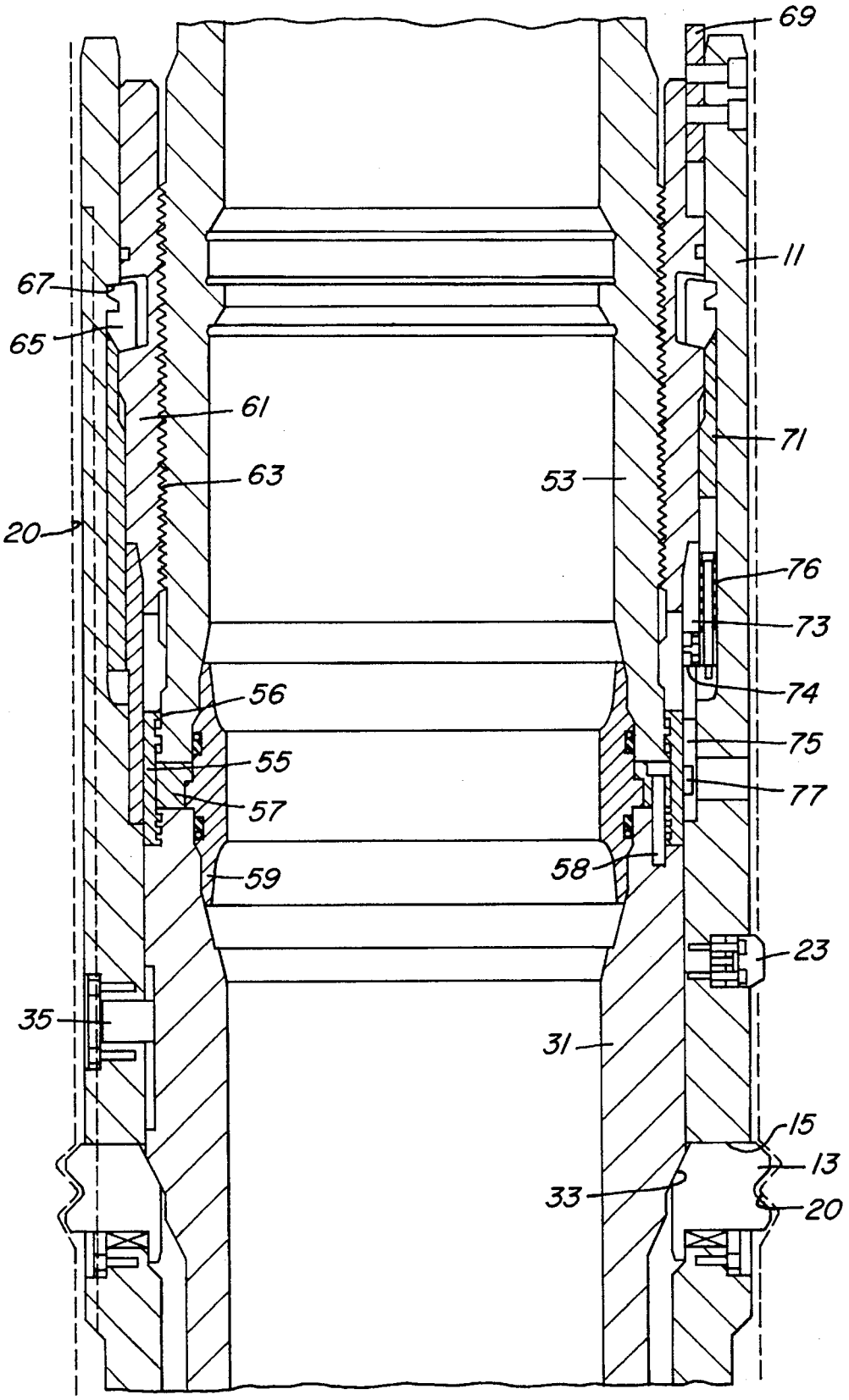
FIGS. 1A and 1B make up a vertical sectional view of a tieback tool constructed in accordance with this invention, and shown in a locked and preloaded position.
Figure 2:
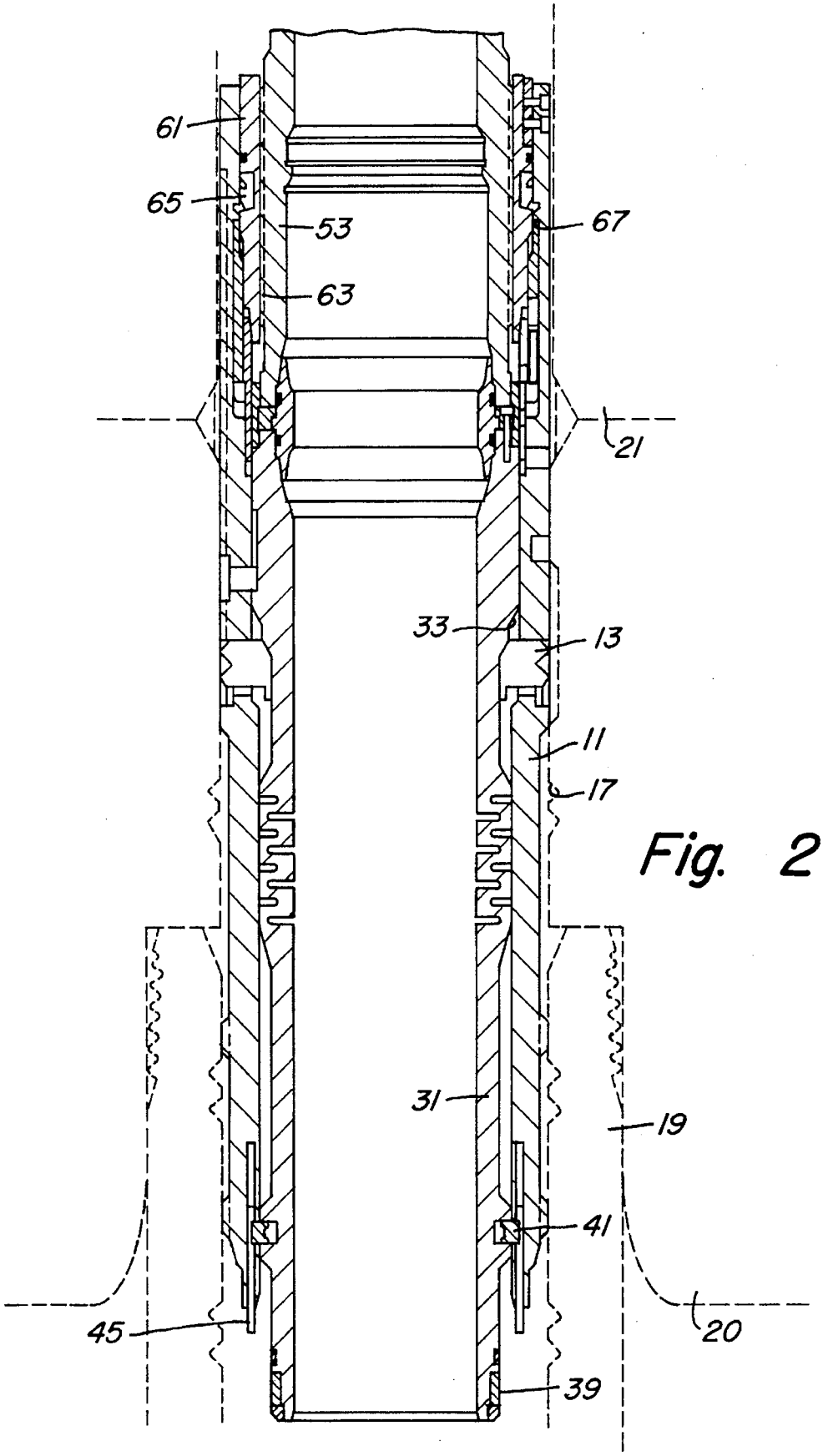
FIG. 2 is a vertical sectional view of the tieback tool of FIG. 1, shown being lowered into a subsea wellhead housing.
Figure 3:
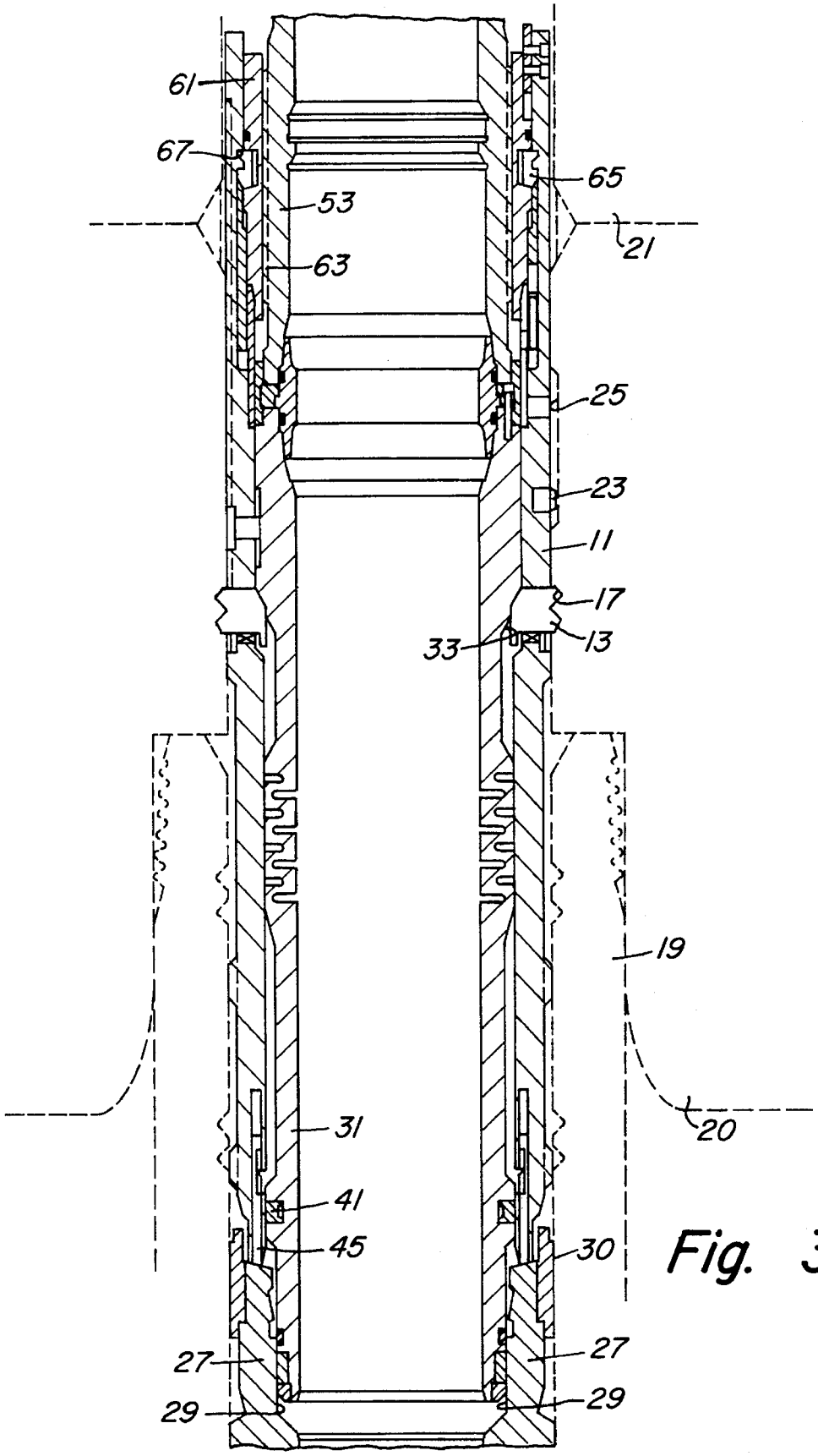
FIG. 3 is a vertical sectional view of the tieback tool of FIG. 1, showing the tieback tool locked, but not yet preloaded.

Referring to FIG. 1A, the tieback tool includes a tubular housing 11. A plurality of dogs 13 are spaced around the circumference of housing 11. Each dog 13 is a locking element that will protrude through an aperture 15 when in the locked position as shown in FIGS. 1A and 3. The released position is shown in FIG. 2. Referring to FIG. 2, a wellhead housing 19 is connected by wellhead connector 20 to an external riser 21 which extends to the platform at the surface (not shown). A grooved profile 17 for receiving dogs 13 is located in an interior of the wellhead connector 20. An antirotation key 23 protrudes from tieback tool housing 11 for engaging a vertical slot 25 located within the wellhead connector 20. Key 23 prevents housing 11 from rotating relative to external riser 21. Riser 21 will have a blowout preventor located at the surface. Wellhead housing 19 and the wellhead connector 20 may be referred to herein as a subsea wellhead assembly.

Figure 4:
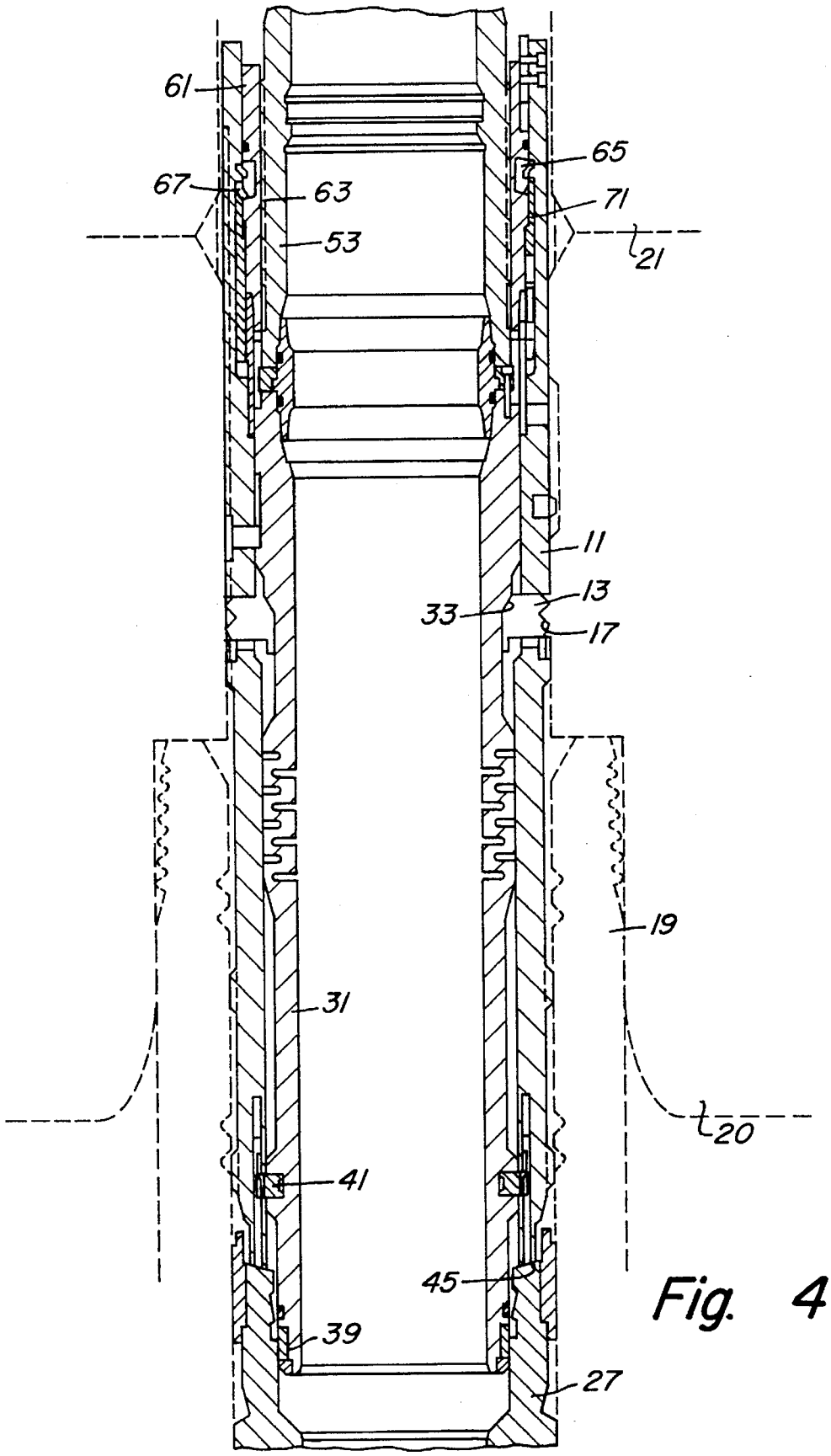
FIG. 4 is a vertical sectional view of the tieback tool of FIG. 1, showing the tieback tool being retrieved.

Referring to FIGS. 3 and 4, subsea wellhead housing 19 will have a casing hanger 27 previously installed. Casing hanger 27 is secured to the upper end of a string of casing (not shown) which extends into the well and is cemented in place. Casing hanger 27 has an internal bowl or sealing surface 29. A conventional annulus seal 30 seals the annulus between casing hanger 27 and the bore of wellhead housing 19.

Figure 1B:
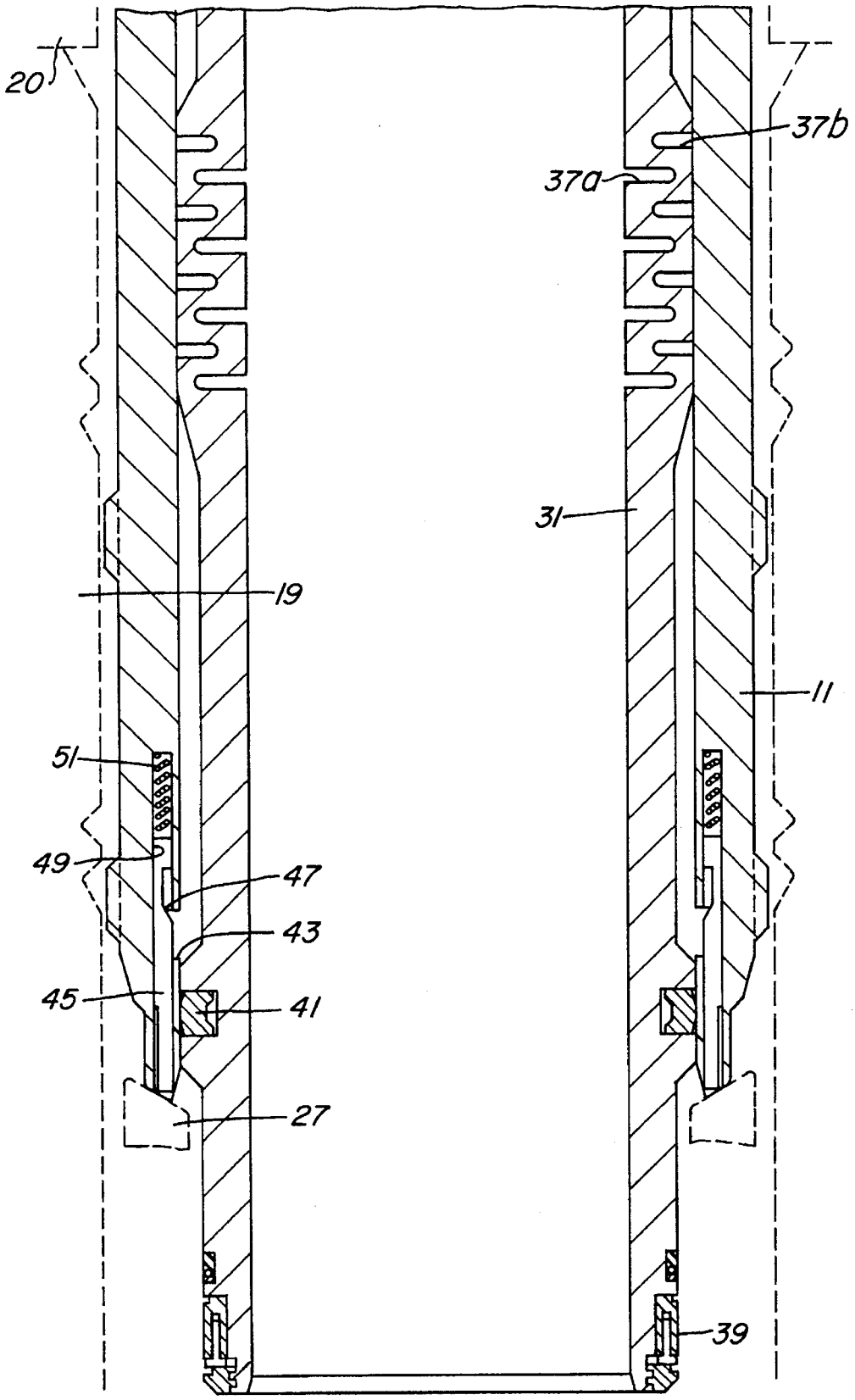

Referring back to FIG. 1, a lower sub portion 31 is carried within housing 11. Lower sub 31 has a cam surface 33 which is a downward facing inclined shoulder. Cam surface 33 engages an upward facing shoulder on each of the dogs 13. When lower sub 31 is moved downward relative to housing 11, dogs 13 are moved outward to the engaged position. FIG. 2 shows lower sub 31 in an upper position, while FIGS. 1A, 1B and 3 show lower sub 31 moved to a lower position. Lower sub 31 is not rotatable relative to housing 11. As shown in FIG. 1A, an antirotation key 35 engages a vertical slot in the exterior of lower sub 31 to prevent such occurrence.

Referring to FIG. 1B, lower sub 31 has a plurality of inner and outer grooves 37*a*, 37*b* formed within it. Grooves 37*a*, 37*b* provide a serpentine configuration to a midsection of lower sub 31. This allows some radial deflection of lower sub 31 to occur for accommodating misalignment. A downward facing U-shaped metal seal 39 is located at the lower end of lower sub 31. Seal 39 will sealingly engage sealing surface 29 as shown in FIG. 3. This seals the bore of lower sub 31 to the bore of casing hanger 27.

Referring again to FIG. 1B, a retaining means will hold lower sub 31 in an upper or retracted position until housing 11 lands on casing hanger 27. The retaining means include a lock ring 41, which is a split ring carried within a groove on the exterior of lower sub 31. When in an expanded position, lock ring 41 will engage a recess 43 located in the interior of housing 11. The outward bias of lock ring 41 will hold lower sub 31 in the upper position shown in FIG. 2 as long as lock ring 41 is within recess 43.

A release means will release the retaining means once housing 11 lands on casing hanger 27. The release means includes a plurality of release pins 45 carried within elongated vertical holes in the lower end of housing 11. Release pins 45 are spaced circumferentially around housing 11 and will move from the retracted position shown in FIG. 1B to the extended position shown in FIG. 2. In the extended position, release pins 45 protrude from the lower end of housing 11. Each release pin 45 has a chamfer 49 with an upward facing shoulder 47 at the base. When in the lower position, chamfer 49 will register with recess 43 and also with lock ring 41. A spring 51 urges each release pin 45 to the lower position. When pins 45 land on casing hanger 27, springs 51 contract and pins 45 will move to the retracted position within housing 11. When moving to the retracted position, shoulders 47 will push lock ring 41 to the retracted position. This allows lower sub 31 to move downward to a position in which seal 39 seals against casing hanger seal surface 29. This position is shown in FIG. 3.

While the tieback tool is in the landed position shown in FIG. 3, dogs 13 will be in locking engagement with profile 17 of wellhead connector 20, but not preloaded. To preload the connection, an upper sub portion 53 is employed with lower sub 31. Upper sub 53 is a tubular member and has a threaded upper end for connection to an internal drilling riser (not shown) which extends through the external riser 21. Upper sub 53 is rotatable relative to lower sub 31.

The rotatable connection means between upper sub 53 and lower sub 31 includes a collar 55. Collar 55 is in two segments and secured by parallel circumferential grooves to the upper end of lower sub 31. Collar 55 is attached to the lower end of upper sub 53 by mating flanges, which allow rotation of upper sub 53 relative to collar 55. A bearing plate 57 is located between the abutting ends of upper sub 53 and lower sub 31. Bearing plate 57 is secured by fasteners 58 to the upper end of lower sub 31. An internal seal 59 seals the bores of the upper and lower subs 53, 31.

There is an axial gap between the flanges 56 which allows the upper sub 53 to be lifted from the lower sub 31 about one-eighth inch. Once lifted, the upper portion of seal 59 is free of engagement with upper sub 53, but remains in stationary engagement with lower sub 31. This allows upper sub 53 to be rotated relative to seal 59 as well as to lower sub 31. After rotation, once compressive forces are applied to upper sub 53, seal 59 will come into engagement with upper sub 53.

A preload sleeve 61 is carried on the exterior of upper sub 53. Preload sleeve 61 and upper sub 53 have mating threads 63. A latch ring 65 on the exterior of preload sleeve will latch into a profile 67 formed in the interior of housing 11. Latch ring 65 can move axially with upper sub 53 and lower sub 31 from an upper position shown in FIG. 2 to a lower position shown in FIGS. 1A and 3. When in the lower position, latch ring 65 snaps into profile 67 due to its outward bias. An antirotation key 69, shown in FIG. 1, is secured to housing 11 and engages a vertical slot in preload sleeve 61 to prevent preload sleeve 61 from rotating relative to housing 11. After latch ring 65 has engaged profile 67, rotating the tieback string causes rotation of upper sub 53, screwing it further downward on threads 63 relative to housing 11 and preload sleeve 61. This pushes lower sub 31 further downward relative to housing 11 and dogs 13, preloading the engagement with the subsea wellhead assembly. An upward force is exerted by dogs 13 on wellhead connector profile 17.

A retrieval means allows the tieback tool to be retrieved by rotating upper sub 53 in the opposite direction or to the left. The retrieval means includes retrieval sleeve 71, shown in FIG. 1A. Retrieval sleeve 71 is located between housing 11 and preload sleeve 61. Retrieval sleeve 71 will move axially relative to housing 11, with the upper end being able to contact and force latch ring 65 to move from the engaged position shown in FIG. 1A to a retracted position shown in FIG. 4. Retrieval sleeve 71 is connected to a linkage sleeve 73 by means of fastener members 74 located within slots 75 in linkage sleeve 73. Springs 76 urge retrieval sleeve 71 downward from linkage sleeve 73. Lugs 77 are secured to the outer diameter of collar 55. Lugs 77 locate within slots 75 of linkage sleeve 73. When collar 55 moves upward relative to linkage sleeve 73, lugs 77 will contact the lower end of fastener members 74, pushing them upward within slots 75. This pushes retrieval sleeve 71 upward relative to housing 11 and preload sleeve 61.

In operation, the well will be drilled to a first depth and wellhead housing 19 will be installed at the sea floor. External riser 21 will extend from wellhead housing 19 to the platform. The well will be drilled to a second depth with one or more strings of casing (not shown) installed and cemented in place. Casing hanger 27 (FIG. 3) will land in wellhead housing 19 and annulus seal 30 will be positioned in place.

Then, to drill to a further depth a higher pressure rating string of internal drilling riser will be employed. The tieback tool is lowered on the string of drilling riser through external riser 21, as shown in FIG. 2. While the tieback tool is being lowered, the lower sub 31 and upper sub 53 will be held in the upper retracted position by lock ring 41. Lock ring 41 will be in its locked position located within housing recess 43 and in engagement with release pin chamfers 49 (FIG. 1B). Dogs 13 will be retracted. The upper latch ring 65 will be retracted and located above profile 67 in housing 11.

Continued lowering of the tieback tool from the position of FIG. 2 causes the release pins 45 to contact the upper end of casing hanger 27, as shown in FIG. 3. The weight of the tieback string forces the release pins 45 to move to the upper retracted position, which is also shown in FIG. 1B. When this occurs, release pin shoulders 47 move the lock ring 41 to the retracted position out of engagement with housing recess 43. The weight of the tieback string forces the subs 31, 55 to move downward relative to housing 11 to the landed position shown in FIG. 3. In this position, seal 39 will sealingly engage casing hanger sealing surface 29. At the same time, cam surface 33 will push dogs 13 out into engagement with profile 17. Also, at the same time, preload sleeve 61 will move downward in unison with upper sub 53. The outward bias of latch ring 65 causes it to spring out into profile 67.

The operator will then preload the tieback tool from the landed position shown in FIG. 3 to the preloaded position shown in FIGS. 1A and 1B. The operator rotates the tieback string to the right about one to two turns. When this occurs, housing 11 is unable to rotate because the antirotation key 23. Similarly, lower sub 31 is unable to rotate because of antirotation key 35. Preload sleeve 61 cannot rotate because of key 69. Upper sub 53 rotates relative to all of these components. Threads 63 cause upper sub 53 to move downward relative to preload sleeve 61. Upper sub 53 pushes downward on lower sub 31 through bearing plate 57, causing lower sub 31 to move downward also. In the event of misalignment, some lateral deflection of lower sub 31 may occur due to the resiliency provided by slots 37*a*, 37*b*. The downward movement pushes dogs 13 further outward into tight engagement with profile 17, exerting an upward force on profile 17. The reactive force is transmitted upward through the latch ring 65 into housing 11. The upward force of latch ring 65 against housing 11 and dogs 13 against profile 17 and of the bottom of housing 11 to the top of hanger 27 preloads the connection. A high pressure blowout preventer will be installed at the surface at the upper end of the tieback string. Drilling will then continue through the internal drilling riser and the tieback tool.

When it is desired to retrieve the tieback tool, the operator rotates the tieback string to the left about six turns. This causes upper sub 53 to move upward relative preload sleeve 61 and housing 11. Lower sub 31 will also move upward because of the connection to upper sub 53 through collar 55. Lugs 77 (FIG. 1A) move upward and contact the lower ends of fastener members 74. This pushes fastener members 74 and retrieval sleeve 71 upward. Retrieval sleeve 71 pushes latch ring 65 inward to the retracted released position shown in FIG. 4. Also, during the upward movement of lower sub 31, dogs 13 will be free to retract due to the upward movement of cam surface 33. Referring to FIG. 1B, the upward movement of lower sub 31 relative to housing 11 causes lock ring 41 to align with housing recess 43.

The operator then lifts the tieback tool four to six inches above the casing hanger 27. Release pins 45 will extend because of springs 51. This causes lock ring 41 to snap into the chamfers 49. The tieback tool is now rotated to the right until it meets a build-up of torque. This resets the tieback tool to the running condition.

The invention has significant advantages. The tieback tool may be run and set through an external riser without the need for any additional running tool. This allows the remote installation of a high pressure drilling riser within an external riser. The invention provides two preload paths. One is from the dogs into the wellhead assembly, down through the outer housing into the casing hanger. The other is internal, from the dogs to the lower sub, to the upper sub, preload sleeve, lock ring, outer housing, and back to the dogs. The load paths cause the interface between the upper and lower subs to remain closed under compression regardless whether the external load is tension, compression, or bending. The dual preload path prevents any seal separation between the upper and lower subs.

While the invention has been shown in only one of its forms, it should be apparent to those skilled in the art that it is not so limited, but is susceptible to various changes without departing from the scope of the invention.

We claim:

1. A tieback apparatus for connecting to a subsea wellhead assembly a tieback string of casing lowered from a platform at the surface, the subsea wellhead assembly having an internal locking profile and a casing hanger therein having an internal sealing surface, the tieback apparatus comprising in combination:

a housing;

a sub carried within the housing and having a lower end containing a seal for sealingly engaging the internal sealing surface of the casing hanger when in a landed position, the sub having an upper end for connecting to the tieback string;

a housing locking element carried by, the housing for locking the housing to the internal locking profile of the subsea wellhead assembly, the housing locking element being movable relative to the housing between a retracted position and an engaged position;

retaining means for carrying the sub in an upper position relative to the housing while the tieback apparatus is being lowered into the subsea wellhead assembly;

release means for releasing the retaining means in response to the housing landing in the subsea wellhead assembly, allowing the sub to move downward to the landed position in sealing engagement with the internal seal surface; and a cam surface on the sub which moves the housing locking element to the engaged position in engagement with the internal locking profile as the sub moves downward to the landed position.

2. The apparatus according to claim 1, wherein the release means comprises:

at least one release member movably carried by the housing at a lower end of the housing, the release member being movable from a lower locked position in which a lower end of the release member protrudes past the lower end of the housing to an upper released position when contacting an upper end of the casing hanger; and the upward movement of the release member in the housing releasing the retaining means.

3. The apparatus according to claim 1, wherein the retaining means comprises:

a lock ring carried on an exterior portion of the sub, the lock ring being radially movable from a released position to a locked position; and an internal recess within the housing for engagement by the lock ring when in the locked position to hold the sub in the upper position; and wherein the release means comprises:

at least one release member movably carried by the housing at a lower end of the housing, the release member being movable from a lower locked position in which a lower end of the release member protrudes past the lower end of the housing to an upper released position when contacting an upper end of the casing hanger, the release member having an upward facing shoulder which moves the lock ring to the released position when the release member moves to the upper released position.

4. The apparatus according to claim 1, wherein the retaining means comprises:

a lock ring carried on an exterior portion of the sub, the lock ring being radially movable from a released position to a locked position; and an internal recess within the housing for engagement by the lock ring when in the locked position to hold the sub in the upper position; and wherein the release means comprises:

a plurality of release pins movably carried by the housing at a lower end of the housing, the release pins being movable from a lower locked position in which lower ends of the release pins protrude past the lower end of the housing to an upper released position recessed within the housing when contacting an upper end of the casing hanger;

the release pins having shoulders which move the lock ring to the released position when the release pins move to the upper released position; and spring means for urging the release pins to the lower locked position.

5. The apparatus according to claim 1, further comprising:

preload means for forcing the sub further downward relative to the locking element from the landed position to a preload position in which the locking element exerts an upward preload force on the profile in the housing.

6. The apparatus according to claim 1, wherein:

the sub has an upper portion and a lower portion, the upper portion being rotatable relative to the lower portion and containing a set of external threads which engage internal threads in the housing, whereby rotation of the upper portion relative to the lower portion forces the upper and lower portions of the sub further downward relative to the locking element from the landed position to a preload position in which the locking element exerts an upward preload force on the profile in the housing.

7. The tieback apparatus according to claim 1, wherein the retaining means resets the sub in the upper position when moving the sub upward relative to the housing from the landed position for retrieval of the tieback apparatus.

8. A tieback apparatus for connecting to a subsea wellhead assembly a tieback string of casing lowered from a platform at the surface, the subsea wellhead assembly having an internal locking profile and a casing hanger therein having an internal sealing surface, the tieback apparatus comprising in combination:

a housing;

a lower sub carried within the housing and having a lower end containing a seal for sealingly engaging the internal sealing surface of the casing hanger;

an upper sub having an upper end for connecting to the tieback string and having a set of external threads;

rotatable connection means for connecting the lower sub to the upper sub to allow rotation of the upper sub relative to the lower sub;

a housing locking element carried by the housing for locking the housing to the internal locking profile of the subsea wellhead assembly, the housing locking element being movable relative to the housing between a retracted position and an engaged position;

retaining means for carrying the lower sub in an upper position relative to the housing while the tieback apparatus is being lowered into the subsea wellhead assembly;

release means operable in response to landing of the housing on the casing hanger for allowing the lower sub to move downward to a landed position in sealing engagement with the internal seal surface;

a cam on the lower sub which moves the housing locking element to the engaged position in engagement with the internal locking profile as the lower sub moves downward to the landed position; and internal threads carried within the housing which engage the external threads on the upper sub, whereby rotation of the upper sub relative to the lower sub in a first direction forces the upper and lower subs further downward relative to the locking element from the landed position to a preload position in which the locking element exerts an upward preload force on the profile in the housing, the engaged threads retaining the upper and lower subs in the preload position.

9. The apparatus according to claim 8, wherein the upper sub moves downward in unison with the lower sub while the lower sub is moving to the landed position; and wherein the apparatus further comprises:

a preload ring carried in the housing and containing the internal threads, the preload ring being movable downward to a lower position in unison with the upper sub while the lower sub is moving to the landed position;

key means for preventing rotation of the preload ring relative to the housing while the preload ring is in the lower position; and means for transmitting to the housing axial load applied to the preload ring by rotation of the upper sub while the preload ring is in the lower position.

10. The apparatus according to claim 8, wherein the upper sub moves downward in unison with the lower sub while the lower sub is moving to the landed position; and wherein the apparatus further comprises:

a preload ring carried in the housing and containing the internal threads, the preload ring being movable downward to a lower position in unison with the upper sub while the lower sub is moving to the landed position;

key means for preventing rotation of the preload ring relative to the housing while the preload ring is in the lower position;

a latch groove located internally within the housing; and a latch element carried by the preload ring and radially movable from a retracted position to an engaged position in engagement with the latch groove, for transmitting to the housing axial load applied to the preload ring by rotation of the upper sub while the preload ring is in the lower position.

11. The apparatus according to claim 8, wherein the upper sub moves downward in unison with the lower sub while the lower sub is moving to the landed position; and wherein the apparatus further comprises:

a preload ring carried in the housing and containing the internal threads, the preload ring being movable downward to a lower position in unison with the upper sub while the lower sub is moving to the landed position;

key means for preventing rotation of the preload ring relative to the housing while the preload ring is in the lower position;

a latch groove located internally within the housing;

a latch element carried by the preload ring and radially movable from a retracted position to an engaged position in engagement with the latch groove, for transmitting to the housing axial load applied to the preload ring by rotation of the upper sub while the preload ring is in the lower position; and wherein the tieback apparatus is retrieved from the wellhead assembly by rotating the upper sub in an opposite direction to the first direction to cause the upper and lower subs to move upward relative to the preload ring; and wherein the tieback apparatus further comprises:

retrieval means for retracting the latch element from engagement with the latch groove while the upper and lower subs are moving upward relative to the preload ring.

12. The apparatus according to claim 8, wherein the rotatable connection means comprises:

a bearing plate located between a lower end of the upper sub and an upper end of the lower sub for allowing rotation of the upper sub relative to the lower sub; and a collar surrounding the bearing plate and connecting the upper and lower subs together.

13. The apparatus according to claim 8, further comprising:

a plurality of grooves formed in the lower sub to allow radial deflection of the lower sub while moving from the landed position to the preload position.

14. The apparatus according to claim 8, wherein the release means comprises:

at least one release member movably carried by the housing at a lower end of the housing, the release member being movable from a lower locked position in which a lower end of the release member protrudes past the lower end of the housing to an upper released position when contacting an upper end of the casing hanger; and the upward movement of the release member in the housing releasing the retaining means.

15. The apparatus according to claim 8, wherein the retaining means comprises:

a lock ring carried in a groove formed on an exterior portion of the sub, the lock ring being radially movable from a released position within the groove to a locked position protruding radially from the groove; and an internal recess within the housing for engagement by the lock ring when in the locked position to hold the sub in the upper position; and wherein the release means comprises:

at least one release member movably carried by the housing at a lower end of the housing, the release member being movable from a lower locked position in which a lower end of the release member protrudes past the lower end of the housing to an upper released position when contacting an upper end of the casing hanger, the release member having an upward facing shoulder which moves the lock ring to the released position when the release member moves to the upper released position.

16. The apparatus according to claim 8, wherein the retaining means comprises:

a lock ring carried on an exterior portion of the sub, the lock ring being radially movable from a released position recessed to a locked position; and an internal recess within the housing for engagement by the lock ring when in the locked position to hold the sub in the upper position; and wherein the release means comprises:

a plurality of release pins movably carried by the housing at a lower end of the housing, the release pins being movable from a lower locked position in which lower ends of the release pins protrude past the lower end of the housing to an upper released position recessed within the housing when contacting an upper end of the casing hanger;

the release pins having shoulders which move the lock ring to the released position when the release pins move to the upper released position; and spring means for urging the release pins to the lower locked position.

17. A tieback apparatus for connecting to a subsea wellhead assembly a tieback string of casing lowered from a platform at the surface, the subsea wellhead assembly having an internal locking profile and a casing hanger therein having an internal sealing surface, the tieback apparatus comprising in combination:

a housing;

a preload ring carried in the housing for limited axial movement between an upper and a lower position and containing a set of internal threads;

a key between the preload ring and the housing for preventing rotation of the preload ring relative to the housing;

a latch groove located internally within the housing;

a latch element carried by the preload ring and radially movable from a retracted position to an engaged position in engagement with the latch groove when the preload ring is in the lower position;

a lower sub carried within the housing and having a lower end containing a seal for sealingly engaging the internal sealing surface of the casing hanger when in a landed position;

an upper sub having an upper end for connecting to the tieback string and having a set of external threads which engage the internal threads of the preload ring;

rotatable connection means for connecting the lower sub to the upper sub to allow rotation of the upper sub relative to the lower sub;

a housing locking element carried by the housing for locking the housing to the internal locking profile of the subsea wellhead assembly, the housing locking element being movable relative to the housing between a retracted position and an engaged position;

a lock ring carried on an exterior portion of the sub, the lock ring being radially movable from a released position to a locked position;

an internal recess within the housing for engagement by the lock ring when in the locked position to hold the sub in an upper position;

a plurality of release pins movably carried by the housing at a lower end of the housing, the release pins being movable from a lower locked position in which lower ends of the release pins protrude past the lower end of the housing to an upper released position recessed within the housing when contacting an upper end of the casing hanger;

the release pins having shoulders which move the lock ring to the released position when the release pins move to the upper released position, allowing the upper and lower subs to move downward relative to the housing to the landed position, the preload ring moving downward simultaneously to the lower position wherein the latch element engages the latch groove;

a cam on the lower sub which moves the housing locking element to the engaged position in engagement with the internal locking profile as the upper and lower subs move downward to the landed position; and whereby rotation of the upper sub in a first direction relative to the preload ring and the lower sub forces the upper and lower subs further downward relative to the locking element from the landed position to a preload position in which the locking element exerts an upward preload force on the profile in the housing, the engaged threads retaining the upper and lower subs in the preload position.

18. The tieback apparatus according to claim 17 wherein the tieback apparatus is retrieved from the wellhead assembly by rotating the upper sub in an opposite direction to the first direction to cause the upper and lower subs to move upward relative to the preload ring; and wherein the tieback apparatus further comprises:

retrieval means for retracting the latch element from engagement with the latch groove while the upper and lower subs are moving upward relative to the preload ring.

19. A method of connecting to a subsea wellhead assembly a tieback string of casing lowered from a platform at the surface, the subsea wellhead assembly having an internal locking profile and a casing hanger therein having an internal sealing surface, the method comprising:

mounting a housing locking element to a housing;

mounting a lower sub portion within the housing which has a lower end containing a seal and a cam;

rotatably mounting an upper sub portion to the lower sub portion, the upper sub portion having a set of external threads which engage internal threads located in the housing;

connecting the upper sub portion to the tieback string;

lowering the housing and upper and lower sub portions into the well while retaining the lower sub portion in an upper position relative to the housing;

when the housing lands in the subsea wellhead assembly, releasing the lower sub portion to move downward to a landed position with the seal in sealing engagement with the internal seal surface;

the downward movement of the lower sub portion causing the cam to move the housing locking element to an engaged position in engagement with the internal locking profile; then rotating the upper sub portion relative to the lower sub portion, the rotation of the threads relative to each other forcing the upper sub portion and lower sub downward relative to the locking element to a preload position in which the locking element exerts an upward preload force on the profile in the housing.

20. The method according to claim 19 wherein the step of releasing the lower sub portion to move downward to a landed position occurs in response to the housing landing on the casing hanger.

21. The method according to claim 19 wherein the upper sub moves downward in unison with the lower sub while the lower sub is moving to the landed position.

* * * * *